US006385574B1

(12) United States Patent
Benno

(10) Patent No.: US 6,385,574 B1
(45) Date of Patent: May 7, 2002

(54) REUSING INVALID PULSE POSITIONS IN CELP VOCODING

(75) Inventor: Steven A. Benno, Dover, NJ (US)

(73) Assignee: Lucent Technologies, Inc., Murray Hill, NJ (US)

( * ) Notice: Subject to any disclaimer, the term of this patent is extended or adjusted under 35 U.S.C. 154(b) by 0 days.

(21) Appl. No.: 09/435,587

(22) Filed: Nov. 8, 1999

(51) Int. Cl.[7] ..... G10L 19/00

(52) U.S. Cl. ..... 704/221; 704/229; 704/230

(58) Field of Search ..... 704/221, 229, 704/230

(56) References Cited

U.S. PATENT DOCUMENTS 5,752,029 A * 5/1998 Wissner ..... 395/615
6,167,375 A * 12/2000 Miseki et al. ..... 704/229
6,260,010 B1 * 7/2001 Gao et al. ..... 704/230

* cited by examiner

*Primary Examiner*—William Korzuch
*Assistant Examiner*—Susan McFadden

(57) ABSTRACT

A method and system of vocoding comprising filtering an input signal resulting in an excitation signal having at least one signal pulse translating the location of the signal pulse into one of a plurality of valid track locations in a plurality of signal pulse location references. Data is placed into an invalid track location in the signal pulse location references. The excitation signal having the signal pulse location references is transmitted for receipt by a receiving vocoder.

19 Claims, 6 Drawing Sheets

FIG. 5

400

| POSITION / TRACK | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 1 | 0 | 4 | 8 | 12 | 16 | 20 | 24 | 28 | 32 | 36 | 40 | 44 | 48 | 52 | 56 | 60 |
| 2 | 1 | 5 | 9 | 13 | 17 | 21 | 25 | 29 | 33 | 37 | 41 | 45 | 49 | 53 | 57 | 61 |

402 404 406 408 410 412

FIG. 6

500

| POSITION / TRACK | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 1 | 0 | 4 | 8 | 12 | 16 | 20 | 24 | 28 | 32 | 36 | 40 | 44 | 48 | 52 | 2 | 6 |
| 2 | 1 | 5 | 9 | 13 | 17 | 21 | 25 | 29 | 33 | 37 | 41 | 45 | 49 | 53 | 3 | 7 |

502 504 506 508 510 512 514 516 518

600

REUSING INVALID PULSE POSITIONS IN CELP VOCODING

BACKGROUND OF THE INVENTION

This invention relates to voice compression, and in particular, to code excited linear prediction (CELP) vocoding.

A voice encoder/decoder (vocoder) compresses speech signals in order to reduce the transmission bandwidth required in a communications channel. By reducing the transmission bandwidth required per call, it is possible to increase the number of calls over the same communication channel. Early speech coding techniques, such as the linear predictive coding (LPC) technique, use a filter to remove the signal redundancy and hence compress the speech signal. The LPC filter reproduces a spectral envelope that attempts to model the human voice. Furthermore, the LPC filter is excited by receiving quasi periodic inputs for nasal and vowel sounds, while receiving noise-like inputs for unvoiced sounds.

There exists a class of vocoders known as code excited linear prediction (CELP) vocoders. CELP vocoding is primarily a speech data compression technique that at 4–8 kbps can achieve speech quality comparable to other 32 kbps speech coding techniques. The CELP vocoder has two improvements over the earlier LPC techniques. First, the CELP vocoder attempts to capture more voice detail by extracting the pitch information using a pitch predictor. Secondly, the CELP vocoder excites the LPC filter with a noise like signal derived from a residual signal created from the actual speech waveform. CELP vocoders contain three main components; 1) short term predictive filter, 2) long term predictive filter, also known as pitch predictor or adaptive codebook, and 3) fixed codebook. Compression is achieved by assigning a certain number of bits to each component which is less than the number of bits used to represent the original speech signal. The first component uses linear prediction to remove short term redundancies in the speech signal. The error, or residual, signal that results from the short term predictor becomes the target signal for the long term predictor.

Voiced speech has a quasi-periodic nature and the long term predictor extracts a pitch period from the residual and removes the information that can be predicted from the previous period. After the long term and short term filters, the residual signal is a mostly noise-like signal. Using analysis-by-synthesis, the fixed codebook search finds a best match to replace the noise-like residual with an entry from its library of vectors. The code representing the best matching vector is transmitted in place of the noisy residual. In algebraic CELP (ACELP) vocoders, the fixed codebook consists of a few non-zero pulses and is represented by the locations and signs (e.g. +1 or −1) of the pulses.

In a typical implementation, a CELP vocoder will block or divide the incoming speech signal into frames, updating the short term predictor's LPC coefficients once per frame. The LPC residual is then divided into subframes for the long term predictor and the fixed codebook search. For example, the input speech may be blocked into a 160 sample frame for the short term predictor. The resulting residual may then be broken up into subframes of 53 samples, 53 samples, and 54 samples. Each subframe is then processed by the long term predictor and the fixed codebook search.

Referring to FIG. 1, an example of a single frame of a speech signal 100 is shown. The speech signal 100 is made up of voiced and unvoiced signals of different pitches. The speech signal 100 is received by a CELP vocoder having an LPC filter. The first step of the CELP vocoder is to remove short term redundancies in the speech signal. The resulting signal with the short term redundancies removed is the residual speech signal 200, FIG. 2.

The LPC filter is unable to remove all of the redundant information and the remaining quasi-periodic peeks and valleys in the filtered speech signal 200 are referred to as pitch pulses. The short term predictive filter is then applied to speech signal 200 resulting in the short term filtered signal 300, FIG. 3. The long term predictor filter removes the quasi-periodic pitch pulses from the residual speech signal 300, FIG. 3, resulting in a mostly noise-like signal 400, FIG. 4, which becomes the target signal for the fixed codebook search. FIG. 4 is a plot of a 160 sample frame of fixed codebook target signal 350 divided into three subframes 354, 356, 358. The code value is then transmitted across the communication network.

In FIG. 5, the lookup table 400 used to map the position of the pulses in a subframe is shown. The pulses within the subframe are constrained to lie in one of sixteen possible positions 402 within the lookup table. Because each track 404 has sixteen possible positions 402, only four bits are required to identify each pulse location. Each pulse mapping occurs in an individual track 404. Therefore, two tracks 406, 408 are required to represent positions of two pulses in the subframe.

In the current example 400, the subframe 354, FIG. 4, has only 53 samples in the excitation, making positions 0–52 the only valid positions. Because of the way the tracks 406, 408, FIG. 5, are divided, the tracks 406, 408 contain positions that exceed the length of the original excitation. Positions 56 and 60 in track 1, and positions 57 and 61 in track 2 are invalid. The location of the first two pulses 310, 312, FIG. 4, correspond to sample thirteen and sample seventeen. By using the table 400, FIG. 5, it is determined that sample thirteen lies in position three 410 in the first track 406. The second pulse is in sample seventeen and lies in second track 408 at position four 412. Therefore, the pulses can be represented and transmitted as four bits each respectively. The other pulses 314, FIG. 4, 316, 318, 320 and 322 in the subframe 354 are ignored because the code book has only two tracks.

Regardless of the reason why a pulse position in a track may be invalid, invalid track positions are simply excluded from the search for the best combination of pulse positions. This represents an inefficient use of the $2^n$ track positions permitted by the "n" bits used to encode the pulse positions. What is needed is a way to efficiently use all $2^n$ track positions, thus eliminating invalid positions.

SUMMARY OF THE INVENTION

The inefficiency and waste of the invalid track positions is eliminated by assigning additional valid pulse positions to the invalid track positions or by placing data into the invalid track positions. Assigning additional valid positions to invalid track positions increases the accuracy and quality of the resulting voice signal at a receiving CELP vocoder. The invalid track positions may selectively be used as flags to indicate to the receiving CELP vocoder a change in the processing of the voice signal or how the subsequent encoded bits are to be interpreted.

BRIEF DESCRIPTION OF THE DRAWINGS

The foregoing objects and advantageous features of the invention will be explained in greater detail and others will be made apparent from the detailed description of the present invention, which is given with reference to the several figures of the drawing, in which:

FIG. 5 is a diagram of a known CELP vocoder codebook lookup table with signal pulses constrained to one of sixteen possible pulse positions;

FIG. 6 is a diagram of a CELP vocoder codebook having invalid track positions mapped to valid pulse positions in accordance with an embodiment of the invention;

DETAILED DESCRIPTION

Figure 1:
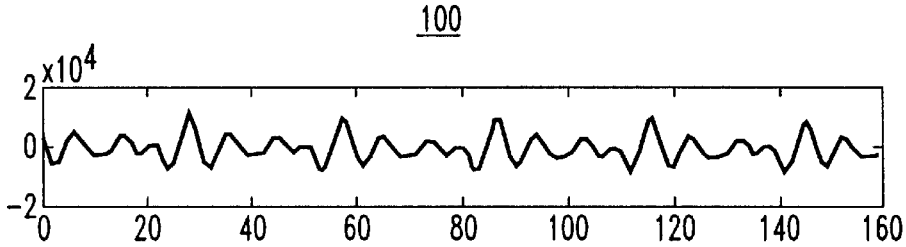
FIG. 1 illustrates a single frame of a speech signal.
Figure 2:
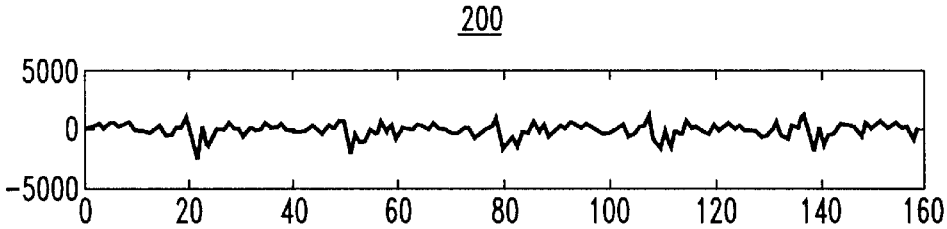
FIG. 2 illustrates a short term periodic filtered single frame of the speech signal.
Figure 3:
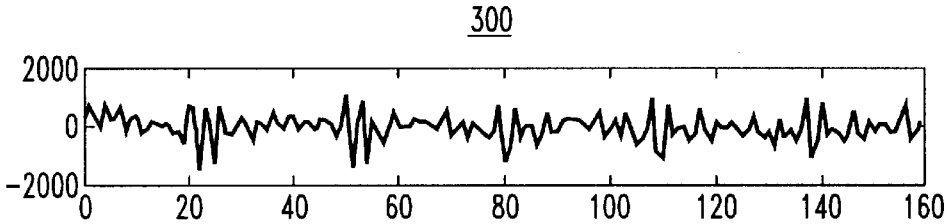
FIG. 3 illustrates an adaptive code book filtered single frame of the speech signal.
Figure 4:
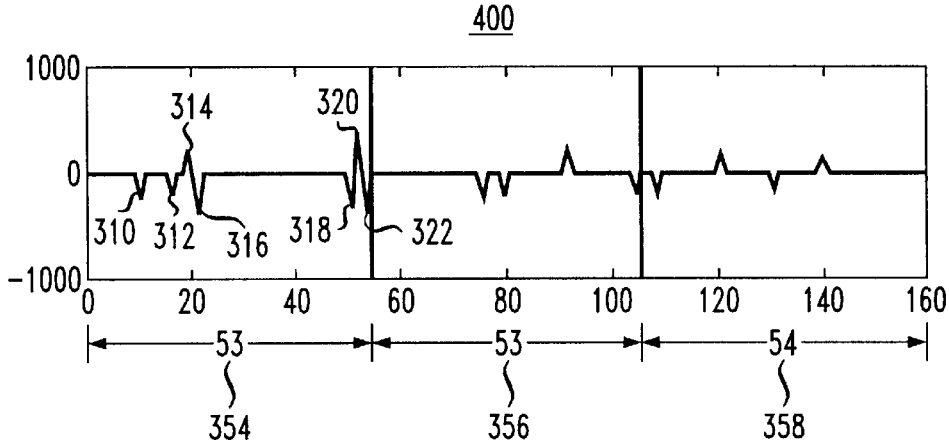
FIG. 4 illustrates a known method of structuring 160 sample speech frame divided into three subframes.

In FIG. 6, a two track codebook table with invalid pulse positions mapped to valid pulse positions is shown. Table 500 contains two pulse position tracks 502, 504 identifying sixteen possible positions 506 for each track. The fixed codebook entries zero through thirteen 506 in tracks one 502 and two 504 are mapped into valid possible pulse positions. The invalid pulse positions in codebook entries fourteen 508 and fifteen 510 have been replaced with valid pulse positions. Codebook entries fourteen 508 and fifteen 510 of the present invention are mapped to valid pulse positions two 512, three 514, six 516, and seven 518 respectively. The addition of valid pulse positions results in increased sensitivity of the reconstructed voice signal. In an alternate embodiment, pulse positions other than two 512, three 514, six 516, and seven 518 may be mapped. Additionally, the previously invalid track positions 512, 514, 506, 518 may selectively contain signaling data (i.e. a flag) that is transferred from the transmitter to a receiver signifying such events as changes in coding, signal strength, or any other relevant data.

Figure 7:
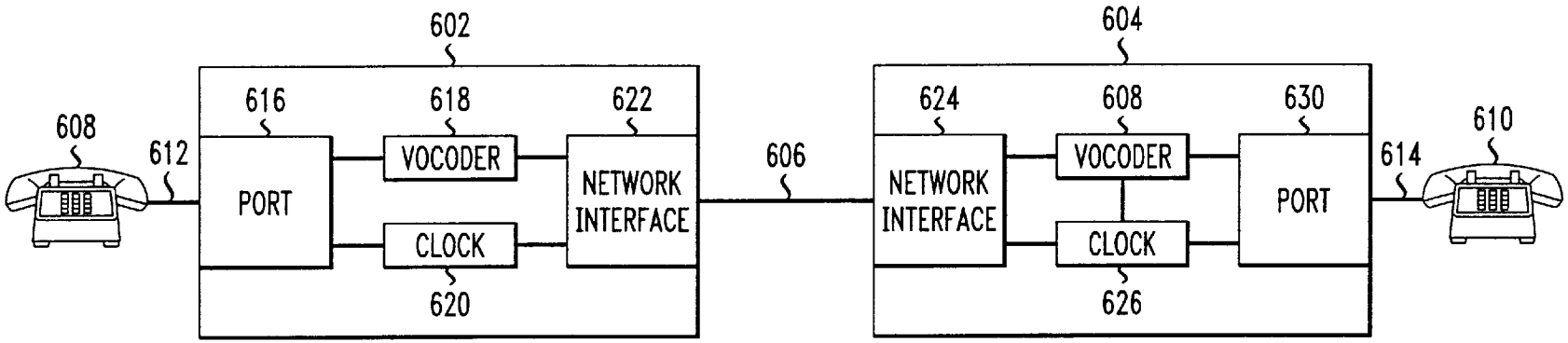
FIG. 7 is a diagram of a communication system with a transmitting device and receiver device using CELP vocoding in accordance with an embodiment of the invention.

Turning to FIG. 7, a communication system 600 having a transmitting device 602 coupled to a receiving device 604 is shown. The transmitting and receiving communication devices 602, 604 are coupled together by a communication path 606. The communication path 606 may selectively be a wire based network (such as a local area network, wide are network, the Internet, ATM network, or public telephone network) or a wireless network (such as cellular, microwave, or satellite network). The main requirement of the communication path 606 is the ability to transfer digital data between the transmitter 602 and the receiver 604.

Each device 602, 604 has a respective signal input/output device 608, 610. Devices 608, 610 are shown as telephonic devices that transfer analog voice signals to and from the transmitter device 602 and receiving device 604. The signal input/output device 608 is coupled to the transmitting device 602 by a two-wire communication path 612. Similarly, the other signal input/output device 610 is coupled to the receiving device 604 over another two-wire communication path 614. In an alternate embodiment, the signal input device may selectively be incorporated in the transmitting and receiving communication devices (i.e. speakers and microphones built into the transmitting and receiving devices)or communicate over a wireless communication path (i.e. cordless telephone).

The transmitting device 602 contains an analog signal port 616 coupled to the two-wire communication path 612, a CELP vocoder 618, and a controller 620. The controller 620 is coupled to the analog signal port 616, the vocoder 618, and a network interface 622. Additionally, the network interface 622 is coupled to the vocoder 618, the controller 620, and the communication path 606.

Similarly, the receiving device 604 has another network interface 624 coupled to another controller 626, the communication path 606, and another vocoder 628. The other controller 626 is coupled to the other vocoder 628, the other network interface 624, and another analog signal port 630. Additionally, the other analog signal port 630 is coupled to the other two-wire communication path 614.

A voice signal is received at the analog port 616 from the signal input device 608. The controller 620 provides the control and timing signals for the transmitting device 602 and enables the analog port 161 to transfer the received signal to the vocoder 618 for signal compression. The vocoder 618 has a fixed codebook with a data structure shown in FIG. 6. The unused or invalid pulse positions are mapped to valid positions allowing an increase in vocoding accuracy. The compressed signal is sent from the vocoder 618 to the network interface 622. The network interface 622 transmits the compressed signal across the communication path 606 to the receiving device 604.

The other network interface 624 located in the receiving device 604 receives the compressed signal. The other controller 626 enables the received compressed signal to be transferred to the other vocoder 628. The other vocoder 628 decodes the compressed signal by using a lookup table 500, FIG. 6. The vocoder 628 regenerates an analog signal from the received compressed signal using the lookup table 500, FIG. 6, having invalid pulse positions mapped to valid pulse position. The lookup table reproduces the fixed codebook contribution and is then filtered by the long term and short term predictor. The analog signal is sent via the other analog signal port 630, FIG. 7, to the other signal input/output device 610.

Figure 8:
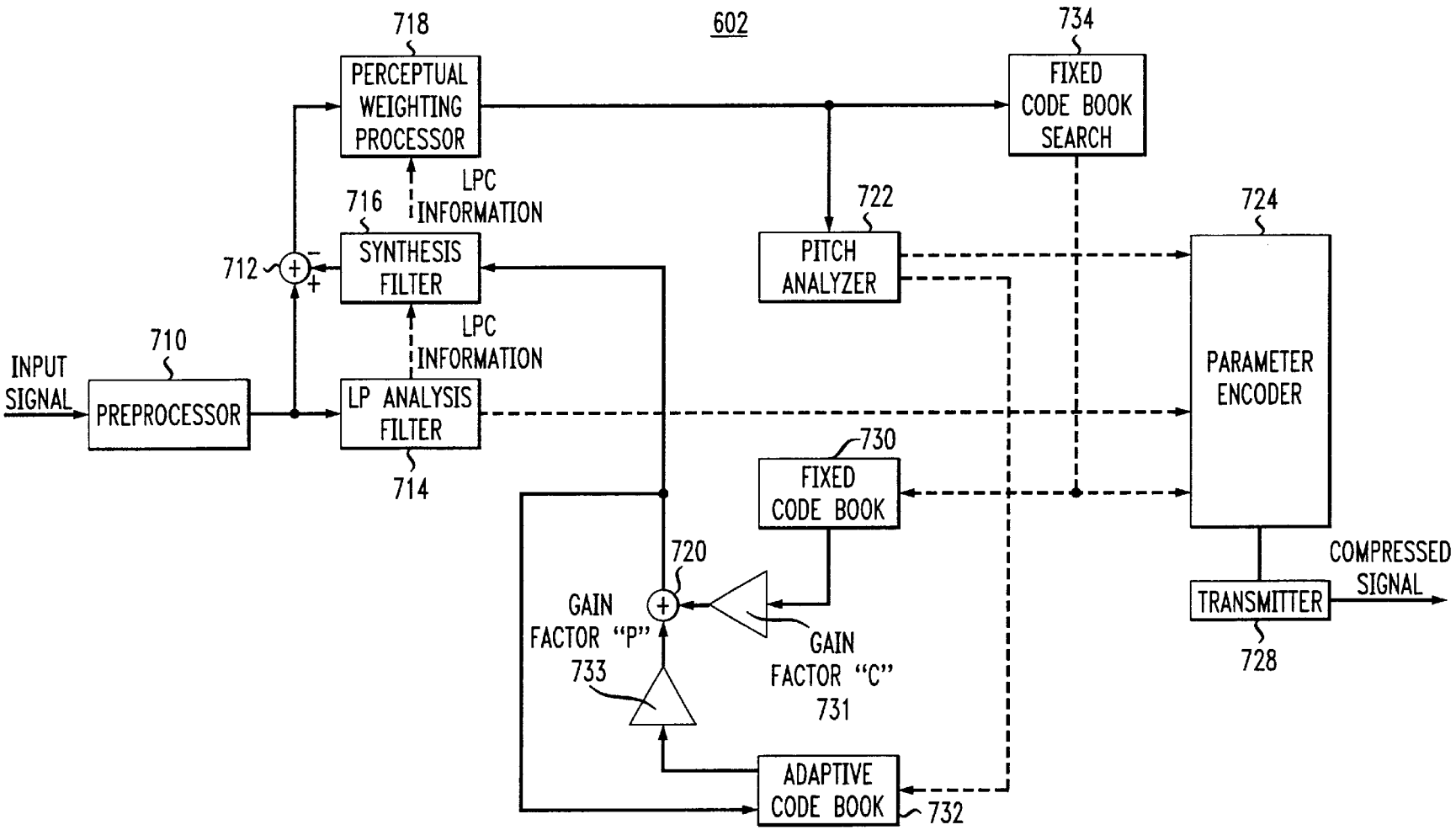
FIG. 8 is a diagram of the transmitting device having a CELP vocoder encoding a voice signal in accordance with an embodiment of the invention.

Turning to FIG. 8, the signal processing of the analog speech signal by the transmitter 602 is shown. A preprocessor 710 has an input for receiving an analog signal and is coupled to an LP filter 714, and a signal combiner 712. The signal combiner 712 combines the signal from the preprocessor 710 and a synthesis filter 716. The output of the signal combiner 712 is coupled to the perceptional weighting processor 718. The synthesis filter 716 is coupled to the LP analysis filter 714, signal combiner 712, another signal combiner 720, an adaptive codebook 732, and a pitch analyzer 722. The pitch analyzer 722 is coupled to the perceptional weighting processor 718, a fixed codebook search 734, an adaptive codebook 732, the synthesis filter 716, the other signal combiner 720, and a parameter encoder 724. The parameter encoder 724 is coupled to a transmitter 728, the fixed codebook search 734, fixed codebook 730, the LP filter 714, and the pitch analyzer 722.

The analog signal is received at the preprocessor 710 from the analog device 608, FIG. 7. The preprocessor 710, FIG.

8, process the signal and adjusts gain and other signal characteristics. The signal from the preprocessor 710 is then routed to both the LP analysis filter 714 and the signal combiner 712. The coefficient information generated by the LP analysis filter 714 is sent to the synthesis filter 716, the perceptual weighting processor 718, and the parameter encoder 724. The synthesis filter 716 receives the LP coefficient information from the LP filter 714 and a signal from the other signal combiner 720. The synthesis filter 716, which models the coarse short term spectral shape of speech, generates a signal that is combined with the output of the preprocessor 710 by the signal combiner 712. The resulting signal from the signal combiner 712 is filtered by the perceptual weighting processor 718. The perceptual weighting processor 718 also receives LP coefficient information from the LP filter 714. The perceptual weighting processor 718 is a post-filter in which the coding distortions are effectively "masked" by amplifying the signal spectra at frequencies that contain high speech energy, and attenuating those frequencies that contain less speech energy.

The output of the perceptual weighting processor 718 is sent to the fixed codebook search 734 and the pitch analyzer 722. The fixed codebook search 734 generates the code values that are sent to the parameter encoder 724 and the fixed codebook 730. The fixed codebook search 734 is shown separate from the fix codebook 730, but may alternatively be included in the fixed codebook 730 and does not have to be implemented separately. Additionally, the fixed codebook search has access to the data structure of the lookup table 500, FIG. 6 with the invalid tracks mapped to valid tracks allowing for more precise pulse signal information to be encoded.

The pitch analyzer 722, FIG. 8, generates pitch data that is sent to the parameter encoder 724 and the adaptive codebook 732. The adaptive codebook 732 receives the pitch data from the pitch analyzer 722, and a feedback signal from the signal combiner 720 to model the long term (or periodic) component of the speech signal. The output of the adaptive codebook signal is combined with the output of the fixed codebook 730 by the signal combiner 720.

The fixed codebook 730 receives the code values generated by the fixed codebook search 734 and regenerates a signal. The generated signal is combined with the signal from the adaptive codebook 732 by signal combiner 720. The resulting combined signal is then used by the synthesis filter 716 to model the short term spectral shape of the speech signal and fed back to the adaptive codebook 732.

The parameter encoder receives parameters from the fixed codebook search 734, the pitch analyzer 722, and the LP filter 714. The parameter encoder using the received parameters generates the compressed signal. The compressed signal is then transmitted by the transmitter 728 across the network.

In an alternate embodiment the above system may selectively be implemented so the encoder and decoder portions of the vocoder reside in the same device, such as a digital answering machine. A communication path in such an embodiment is a data bus that allows the compressed signal to be stored and retrieved from a memory.

Figure 9:
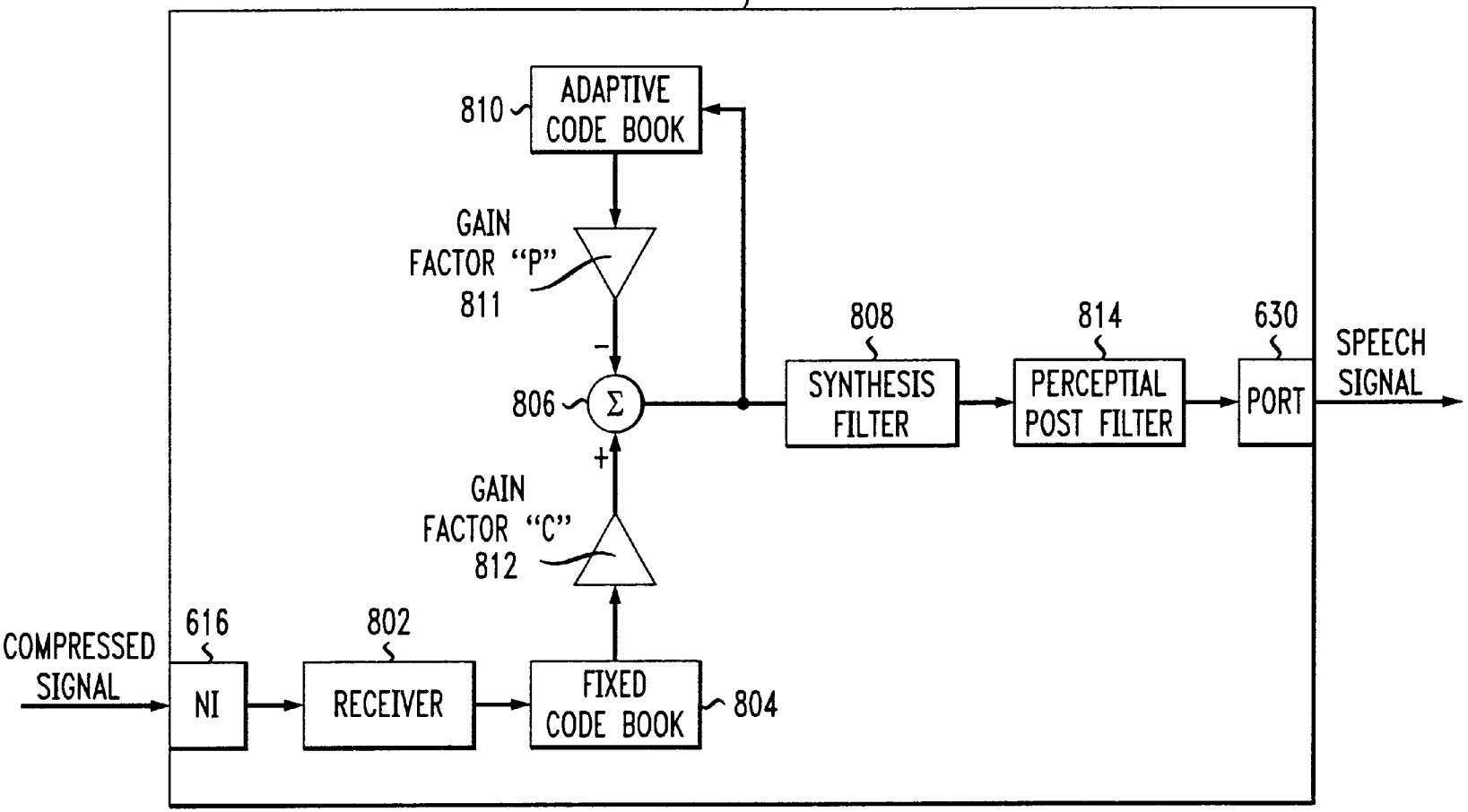
FIG. 9 is a diagram of the receiving device have a CELP vocoder in accordance with an embodiment of the invention.

In FIG. 9, a diagram of the receiving device having a CELP vocoder in accordance with an embodiment of the invention is shown. A receiver 604 has a network interface 661 coupled to a receiver 802. A fixed codebook 804 is coupled to the receiver 802 and a gain factor "c" 812. The signal combiner 806 is coupled to a synthesis filter 808, the gain factor "p" 811 and a gain factor "c" 812. The adaptive codebook 810 is coupled to the gain factor "p" 811 and the output of the signal combiner 806. The synthesis filter 808 is connected to the output of the signal combiner 806 and a perceptual post filter 814. The perceptual post filter is coupled to the other analog port 630 and the synthesis filter 808.

The compressed signal is received by the receiving device 604 at the network interface 616. The receiver 802 unpacks the data from the compressed signal received at the network interface 616. The data consists of a fixed codebook index, a fixed codebook gain, an adaptive codebook index, adaptive codebook gain, and an index for the LP coefficients. The fixed codebook 804 contains a lookup table 500, FIG. 6, data structure that has invalid signal pulses mapped to valid positions. The fixed codebook 804, FIG. 9, generates a signal that is combined by signal combiner 806 with the signal from the adaptive codebook 810 and the gain factor 812. The combined signal from the signal combiner 806 is then received at the synthesis filter 808 and fed back into the adaptive codebook 810. The synthesis filter 808 uses the combined signal to regenerate the speech signal. The regenerated speech signal is passed through the perceptual post filter 814 that adjusts the speech signal. The speech signal is then sent to the receiver by the analog port 630.

Figure 10:
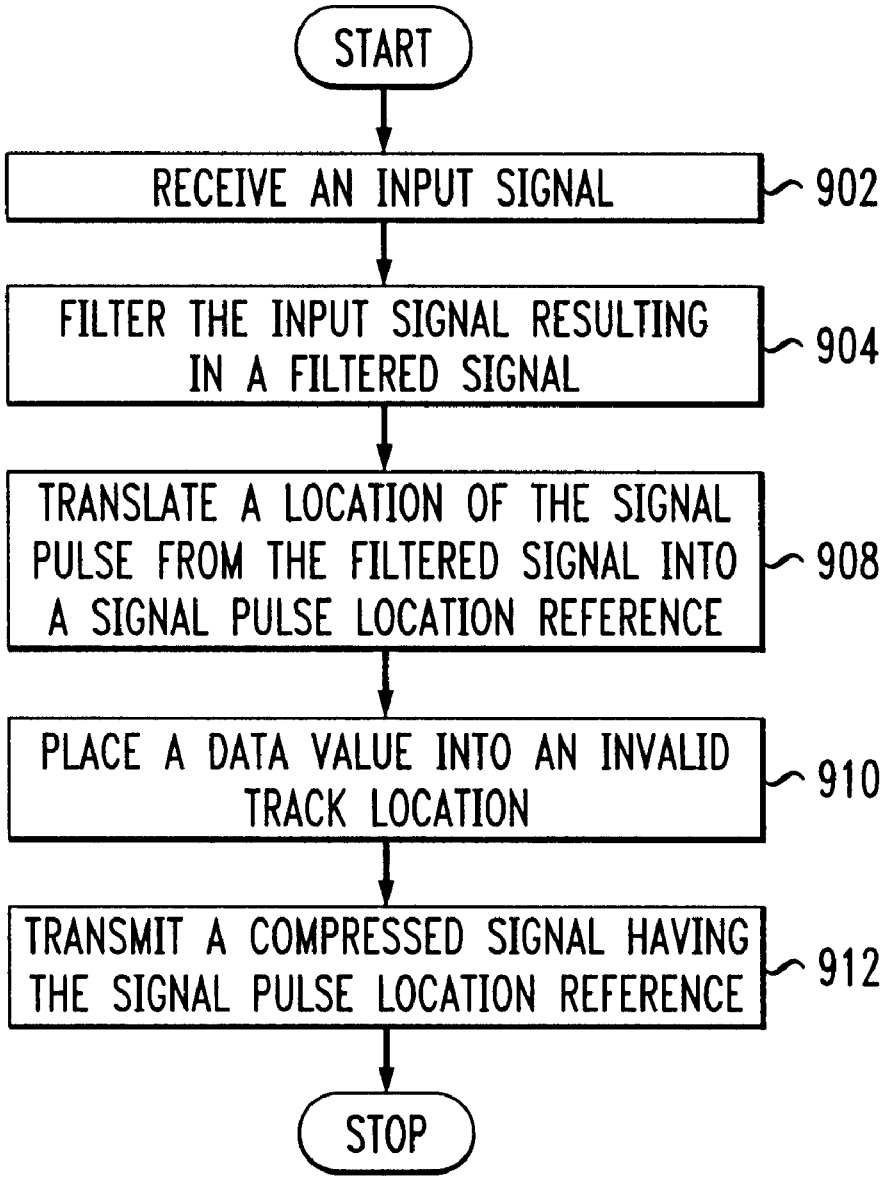
FIG. 10 is a flow chart of a method of vocoding a voice signal in accordance with an embodiment of the invention.

Turning to FIG. 10, a flow chart illustrates a method of vocoding using a lookup table having invalid pulse locations mapped to valid pulse locations. In step 902, an input signal (e.g., an analog voice signal) is received at a receiving device 604, FIG. 7. The input signal is processed by a filter 714, FIG. 8, in step 904, FIG. 10, resulting in a filtered input signal. In step 908, FIG. 10, the adaptive codebook 732, FIG. 8, translates or removes the long term signal redundancy from the filtered input signal having signal pulses. In step 910, FIG. 10, the fixed codebook index is used to identify the location of the signal pulses within tracks. The fixed codebook 730, FIG. 8, contains a lookup table 500, FIG. 6, having valid pulse positions and invalid pulse positions mapped to valid pulse positions. In an alternate embodiment, the invalid pulse positions my selectively be used to transmit signaling data values or other types of data. The lookup table 500 is used by the fixed codebook 730, FIG. 8, to generate a binary pattern that represents remaining pulse signals from the signal. The binary pattern is then encoded into a compressed signal containing the remaining pulse signals and transmitted across the communication path, step 912, FIG. 10.

Current state of technology allows general purpose digital signal processors to be combined with other electronic elements in order to make a CELP vocoder that is configured by software. Therefore, a computer readable medium may contain software code to implement a CELP vocoder having invalid pulse positions mapped to valid positions or data placed in invalid pulse positions.

While the invention has been particularly shown and described with reference to a particular embodiment, it will be understood by those skilled in the art that various changes in form and details may be made therein without departing from the spirit and scope of the invention and it is intended that all such changes come within the scope of the following claims.

What is claimed is:

1. A method of vocoding, the method comprising the steps of:

filtering an input signal resulting in an excitation signal having at least one signal pulse;

translating a location of the at least one signal pulse into one of a plurality of valid track positions in a plurality of valid pulse positions;

placing a data value into an extra track position in the plurality of valid pulse positions through employment of a lookup table that serves to map a plurality of extra track positions to respective instances of the plurality of valid pulse positions, wherein the plurality of extra track positions comprises the extra track position; and transmitting the excitation signal having the plurality of valid pulse positions for receipt by a receiving vocoder.

2. The method of claim 1, including the step of assigning the extra track position to a valid pulse position of the plurality of valid pulse positions.

3. The method of claim 1, wherein the step of placing comprises the step of placing a flag into the extra track position, wherein the flag is related to a codebook that comprises the lookup table.

4. The method of claim 1, wherein the step of placing comprises the step of placing a flag into the extra track position to represent how the at least one signal pulse is encoded into the extra track position, wherein the flag is related to a codebook that comprises the lookup table.

5. An apparatus for vocoding an input signal, the apparatus comprising:

a filter for generating a filtered signal with at least one signal pulse in response to receiving the input signal;

a processor having a lookup table with a plurality of valid track positions and an extra track position of a plurality of extra track positions for constraining the at least one signal pulse to one of the plurality of valid track positions and placing a data value in the extra track position resulting in a plurality of excitation parameters in response to receiving the filtered signal from the filter, wherein the lookup table serves to map a plurality of extra track positions to respective instances of the plurality of valid pulse positions; and a transmitter which encodes the plurality of excitation parameters into a transmission signal in response to receiving the plurality of excitation parameters from the processor.

6. The apparatus of claim 5, wherein the extra track position in the lookup table is mapped to a valid pulse position of the plurality of valid pulse positions for constraining the at least one signal pulse.

7. The apparatus of claim 5, wherein the data value placed into the extra track position is a flag, wherein the flag is related to a codebook that comprises the lookup table.

8. The apparatus of claim 5, wherein the data value placed into the extra track position is a flag identifying the type of encoding of the at least one signal pulse, wherein the flag is related to a codebook that comprises a lookup table.

9. A system with a transmitting device having an encoder for encoding a signal having at least one signal pulse and a receiving device having a decoder coupled together by a communication path, the system comprising:

a first memory in the transmitting device having a first track position data structure with a plurality of valid track positions for constraining the at least one signal pulse and an extra track position;

a first processor in the transmitting device coupled to the first memory, for placing a data value into the extra track position of the first track position data structure through employment of a lookup table that serves to map a plurality of extra track positions to respective instances of a plurality of valid pulse positions, wherein the plurality of extra track positions comprises the extra track position;

a transmitter in the transmitting device coupled to the first memory, for transmitting an encoded signal to the receiving device via the communication path;

a receiver in the receiving device for receiving the encoded signal via the communication path from the transmitting device;

a second memory in the receiving device coupled to the receiver, having a second track position data structure with an other plurality of valid track positions and an other extra track position; and a second processor in the receiving device coupled to the second memory, for reading the data from the other extra track position in the second track position data structure.

10. The system of claim 9, wherein the data value in the extra track position in the first track position data structure is a pulse position of the at least one signal pulse.

11. The system of claim 10, wherein the data value in the other extra track position in the second track position data structure is the pulse position of the at least one signal pulse.

12. The system of claim 9, wherein the data value in the extra track position of the first track position data structure is a flag, wherein the flag is related to a codebook that comprises the lookup table.

13. The system according to claim 12, wherein the data value in the other extra track position in the second track position data structure is a flag, wherein the flag is related to a codebook that comprises the lookup table.

14. The system according to claim 9, wherein the data value in the extra track position in the first data structure is a flag identifying a type of encoding of the at least one signal pulse, wherein the flag is related to a codebook that comprises the lookup table.

15. The system according to claim 14, wherein the data value in the other extra track position in the second data structure is a flag identifying a type of encoding of the at least one signal pulse, wherein the flag is related to a codebook that comprises the lookup table.

16. An apparatus having for compressing a signal having at least one signal pulse, the apparatus comprising:

an encoder for receiving the signal;

a memory coupled to the encoder having a track position data structure with an extra track position and a plurality of valid track positions for constraining the at least one signal pulse;

a controller coupled to the memory storing an encoded signal in the memory, in response to placing a data value into the extra track position of the track position data structure through employment of a lookup table that serves to map a plurality of extra track positions to respective instances of a plurality of valid pulse positions, wherein the plurality of extra track positions comprises the extra track position; and a decoder device coupled to the memory and the controller, decoding the data value from the encoded signal by accessing the extra track position in the track position data structure in the memory in response to the controller retrieving the encoded signal from the memory.

17. An article of manufacture, comprising:

a computer usable medium having computer readable program code means embodied therein for vocoding of a signal, the computer readable program code means in said article of manufacture having:

means having a first computer readable program code for filtering of the signal resulting in an residual signal, means having a second computer readable program code for identifying a codebook index from a codebook having a track and a plurality of valid pulse positions and at least one extra pulse position, wherein the codebook comprises a lookup table that serves to map a plurality of extra track positions to respective instances of the plurality of valid pulse positions, and means having a third computer readable program code means for inserting a data value into the at least one extra pulse position in the track.

18. The article of manufacture of claim 17, wherein the computer readable program code means in said article of manufacture comprises:

a fourth computer readable program code means for generating a flag identifying a type of encoding of the at least one signal pulse, wherein the flag is related to the codebook, and a fifth computer readable program code means for inserting the flag as the data value into the at least one extra pulse position in the track.

19. The article of manufacture of claim 7, wherein the computer readable program code means comprises:

a computer readable program code means for assigning the at least one extra pulse position to valid pulse positions.

* * * * *